US006931854B2

(12) United States Patent
Saitoh et al.

(10) Patent No.: US 6,931,854 B2
(45) Date of Patent: Aug. 23, 2005

(54) COMBUSTOR CONTAINING FUEL NOZZLE

(75) Inventors: Keijirou Saitoh, Takasago (JP); Takashi Kawano, Takasago (JP); Hidemi Niinai, Takasago (JP); Yutaka Kawata, Takasago (JP); Shigemi Mandai, Takasago (JP); Kuniaki Aoyama, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 82 days.

(21) Appl. No.: 10/287,507

(22) Filed: Nov. 5, 2002

(65) Prior Publication Data

US 2003/0089801 A1 May 15, 2003

(30) Foreign Application Priority Data

Nov. 14, 2001 (JP) ..... 2001-349246

(51) Int. Cl.[7] ..... F02C 1/00; F02G 3/00

(52) U.S. Cl. ..... 60/737; 60/740; 60/742

(58) Field of Search ..... 60/737, 740, 742, 60/746, 747, 748; 239/399, 403, 426, 432; 431/181, 182

(56) References Cited

U.S. PATENT DOCUMENTS 5,437,159 A * 8/1995 Ansart et al. ..... 60/746
5,613,363 A 3/1997 Joshi et al.
6,141,967 A 11/2000 Angel et al. ..... 60/737
6,164,055 A 12/2000 Lovett et al. ..... 60/39.06
6,192,688 B1 2/2001 Beebe
6,675,581 B1 * 1/2004 Stuttaford et al. ..... 60/737
6,684,641 B2 * 2/2004 Moriya et al. ..... 60/737
6,691,516 B2 * 2/2004 Stuttaford et al. ..... 60/737
2002/0014078 A1 * 2/2002 Mandai et al. ..... 60/737
2003/0014975 A1 * 1/2003 Nishida et al. ..... 60/737
2003/0110774 A1 * 6/2003 Saitoh ..... 60/737
2004/0006989 A1 * 1/2004 Stuttaford et al. ..... 60/776
2004/0006991 A1 * 1/2004 Stuttaford et al. ..... 60/776
2004/0006992 A1 * 1/2004 Stuttaford et al. ..... 60/776
2004/0006993 A1 * 1/2004 Stuttaford et al. ..... 60/776

FOREIGN PATENT DOCUMENTS

JP 2002-364849 12/2002

* cited by examiner

*Primary Examiner*—Cheryl Tyler
*Assistant Examiner*—William H. Rodriguez
(74) *Attorney, Agent, or Firm*—Oblon, Spivak, McClelland, Maier & Neustadt, P.C.

(57) ABSTRACT

There is provided a combustor comprising a fuel nozzle which is comprised of a rodlike body which has a fuel passage and which is located in an air passage; a plurality of hollow members which are connected to the fuel passage and which extend in radial directions from the rodlike body into the air passage; at least one injection port formed in each hollow member to inject a fuel from the fuel passage into the air passage; and a projection which extends from a farmost inner wall of each hollow member that is most distant from an axis of the rodlike body to the injection port that is most distant from the axis. A hole for leaking fuel that is connected to an air passage may be formed in a farmost inner wall of the hollow member that is more distant from an axis of a rodlike body than the injection port that is most distant from the axis, or may be formed to be adjacent to all the injection ports on an upstream or downstream side in the direction of the airflow. Thus, a vortex does not occur in the hollow column.

4 Claims, 8 Drawing Sheets

COMBUSTOR CONTAINING FUEL NOZZLE

BACKGROUND OF THE INVENTION

1. Field of the Invention

The present invention relates to a combustor containing a fuel nozzle to supply fuel. Particularly, it relates to a gas turbine combustor.

2. Description of the Related Art

FIG. 1 shows an axial direction sectional view of a combustor containing a known fuel nozzle disclosed in Japanese Patent Application No. 2001-173005. As shown in FIG. 1, a pilot nozzle 300 is provided on an central axis of inner tube 180 of a combustor 100. A plurality of fuel nozzles 200, which extend substantially parallel to the pilot nozzle 300, are equally spaced in a peripheral direction around the pilot nozzle 300. Fuel is supplied to the pilot nozzle 300 and fuel nozzles 200. A swirl vane or a swirler 290 is disposed around a rodlike body of the fuel nozzle 200. A plurality of hollow columns 250 which radially and outwardly extend from the sidewall of the fuel nozzle 200 are provided on the fuel nozzle 200. The hollow columns 250 are connected to the fuel nozzle 200. A plurality of injection ports 260 are provided in each hollow column 250 to inject fuel toward a tip end of the fuel nozzle 200. A mixing chamber 150 is formed in the vicinity of the tip end of the fuel nozzle 200, and a pilot combustion chamber 160 is defined by a pre-mixing nozzle 170 in the vicinity of the tip end of the pilot nozzle 300.

The path of air for combustion that enters the combustor 100 through an air inlet 110 thereof is changed by about 180° at an inner tube end portion 120 to allow the air to flow into an air passage 140. A part of air for combustion is mixed with fuel injected from injection ports 260 of the hollow column 250 and, then, flows into the swirler 290 of the fuel nozzle 200. Accordingly, the air for combustion is rotated mainly in a peripheral direction and mixture of the air for combustion and the fuel is promoted. Thus, pre-mixed air is produced in the mixing chamber 150.

The remaining of air for combustion flows into the swirler 390 disposed between the pilot nozzle 300 and the pre-mixing nozzle 170. The air for combustion is burnt with fuel injected from the pilot nozzle 300, in the pilot combustion chamber 160, to produce a pilot flame. Pre-mixed air mixed with fuel injected from the injection ports 260 of the hollow column 250 is brought into contact with the pilot flame and then is burnt to produce a main flame.

FIG. 2*a* is a sectional view taken along the line A—A in FIG. 1. FIG. 2*b* is an enlarged sectional view of a fuel nozzle of a known combustor. As described above, a plurality of hollow columns 250 which radially and outwardly extend from the fuel nozzle 200 are provided on the fuel nozzle 200. As shown in FIG. 2*b*, a plurality of fuel injection ports 260 to inject fuel in a direction perpendicular to the airflow are formed in each hollow column 250. A plurality of injection ports 260 (for example, two injection ports 260 in FIG. 2*b*) are arranged, in a line, in the vicinity of a center of the width of the hollow column 250. There is a space between the injection port 260*a* that is most distant from an axis B of the fuel nozzle 200 and the inner wall 430 of the hollow column 250 that is most distant from the axis. In FIG. 2*b*, the length of the space is similar to a half of the distance between injection ports adjacent to each other. If the inner wall 430 of the hollow column 250 is adjacent to the injection port 260*a*, less fuel is injected from the injection port 260*a* than from other injection ports and, thus, such a space is necessary. As shown in FIGS. 2*a* and 2*b*, it is preferable that these plural hollow columns 250 be planar and, thereby, a flow with a low pressure drop and less volution can be produced. This is because the projected area of the hollow column 250 in the direction of the airflow can be minimized if the hollow column 250 is planar. Therefore, a pressure drop and volution of the flow can be reduced as the thickness of the planar hollow column 250 is reduced. The injection port 260 shown in FIG. 2*b* is a circle-shaped hole having a diameter of 1.8 mm, and a thickness 270 of a passage 410 of the hollow column 250 is 1.5 mm.

However, the thickness of the planar hollow column 250 is reduced, so that the thickness 270 of the passage 410 in the planar hollow column 250 is relatively reduced. Accordingly, the fuel passing through the hollow column 250 flows two-dimensionally. Thus, a vortex 900 occurs in the vicinity of a tip end 420 of the hollow column 250. If a plurality of fuel injection ports 260 are formed in one hollow column 250, the vortex occurs around the injection port 260*a* that is most distant from the axis B of the fuel nozzle 200. Therefore, it is difficult to inject fuel through the injection port 260*a*. Accordingly, the flow coefficient of the farmost injection port 260*a* is smaller than that of other injection ports, and a deviation of the flow coefficient between the farmost injection port 260*a* and the other injection ports is increased. Thus, the stability of injection of fuel is reduced as the flow coefficient is decreased. There is a possibility that a combustion vibration may occur because uniform pre-mixed air is not produced due to scattering of a flow coefficient.

If pre-mixed air in which a mixture of fuel and air is unbalanced is used, $NO_x$ is formed. Therefore, it is necessary to produce pre-mixed air having a uniform concentration to reduce $NO_x$. However, in a combustor containing a fuel nozzle disclosed in Japanese Patent Application No. 2001-173005, the concentration of fuel becomes high in the vicinity of the axis B of the fuel nozzle 200 and becomes low in the vicinity of the injection port 260*a* due to the vortex 900. Accordingly, it is difficult to produce pre-mixed air that is uniformly mixed. It is preferable that the amount of fuel injected from the injection port be determined in accordance with only the size of the injection port, regardless of the distance of the injection port from the axis. In terms of reduction of $NO_x$, it is necessary to avoid scattering of a flow coefficient in each injection port.

Therefore, the object of the present invention is to provide a combustor containing a fuel nozzle in which a vortex cannot occur in a hollow column.

SUMMARY OF THE INVENTION

To achieve the above object, one embodiment of the present invention provides a combustor comprising a fuel nozzle which is comprised of a rodlike body which has a fuel passage and which is located in an air passage; a plurality of hollow members which are connected to the fuel passage and which extend in radial directions from the rodlike body into the air passage; at least one injection port formed in each hollow member to inject a fuel from the fuel passage into the air passage; and a projection which extends from a farmost inner wall of each hollow member that is most distant from an axis of the rodlike body to the injection port that is most distant from the axis.

Namely, according to the one embodiment of the present invention, fuel can be uniformly injected through the injection port because an occurrence of a vortex in the hollow column can be prevented. Thus, uniformly mixed pre-mixed air can be produced because the occurrence of $NO_x$ can be reduced. A combustion vibration can be prevented because the flow coefficient can be stabilized.

According to a other embodiment of the present invention, there is provided a combustor comprising a fuel nozzle which is comprised of a rodlike body which has a fuel passage and which is located in an air passage; a plurality of hollow members which are connected to the fuel passage and which extend in radial directions from the rodlike body into the air passage; at least one injection port formed in each hollow member to inject a fuel from the fuel passage into the air passage, wherein a hole which is connected to the air passage and through which the fuel leaks is formed in a farmost inner wall of each hollow member that is most distant from an axis of the rodlike body.

Namely, according to another embodiment of the present invention, the occurrence of the vortex can be relatively easily prevented, without providing a projection, by leaking a part of fuel through a hole. Accordingly, the occurrence of $NO_x$ can be reduced because the uniformly mixed pre-mixed air can be produced. The combustion vibration can be prevented because the flow coefficient can be stabilized. Also, the combustor containing such a fuel nozzle can be easily manufactured at a low cost.

According to another embodiment of the present invention, there is provided a combustor comprising a fuel nozzle which is comprised of a rodlike body which has a fuel passage and which is located in an air passage; a plurality of hollow members which are connected to the fuel passage and which extend in radial directions from the rodlike body into the air passage; at least one injection port formed in each hollow member to inject a fuel from the fuel passage into the air passage; wherein an inner wall of each hollow member is formed to be adjacent to all the injection port on an upstream or downstream side in the direction of the airflow.

Namely, according to the other embodiment of the present invention, the occurrence of the vortex can be relatively easily prevented without providing the projection. Accordingly, the occurrence of $NO_x$ can be reduced because the uniformly mixed pre-mixed air can be produced. A combustion vibration can be prevented because the flow coefficient can be stabilized. Also, the combustor containing such a fuel nozzle can be easily manufactured at a low cost.

These and other objects, features and advantages of the present invention will be more apparent, in light of the detailed description of exemplary embodiments thereof, as illustrated by the drawings.

BRIEF DESCRIPTION OF THE DRAWING

The present invention will be more clearly understood from the description as set below with reference to the accompanying drawings, wherein.

DESCRIPTION OF THE PREFERRED EMBODIMENTS

Figure 1:
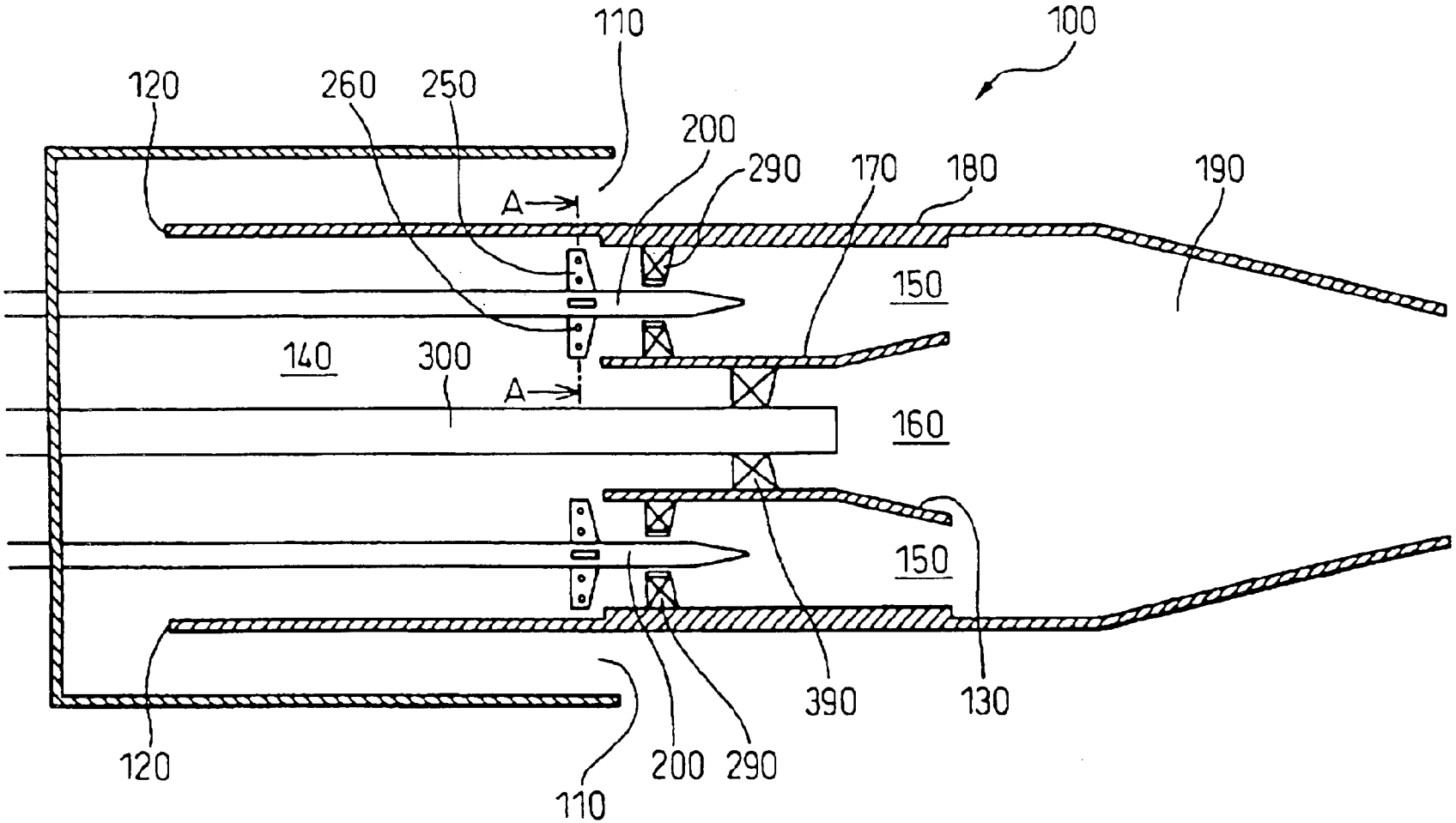
FIG. 1 is an axial direction sectional view of a known gas turbine combustor.
Figure 2A:
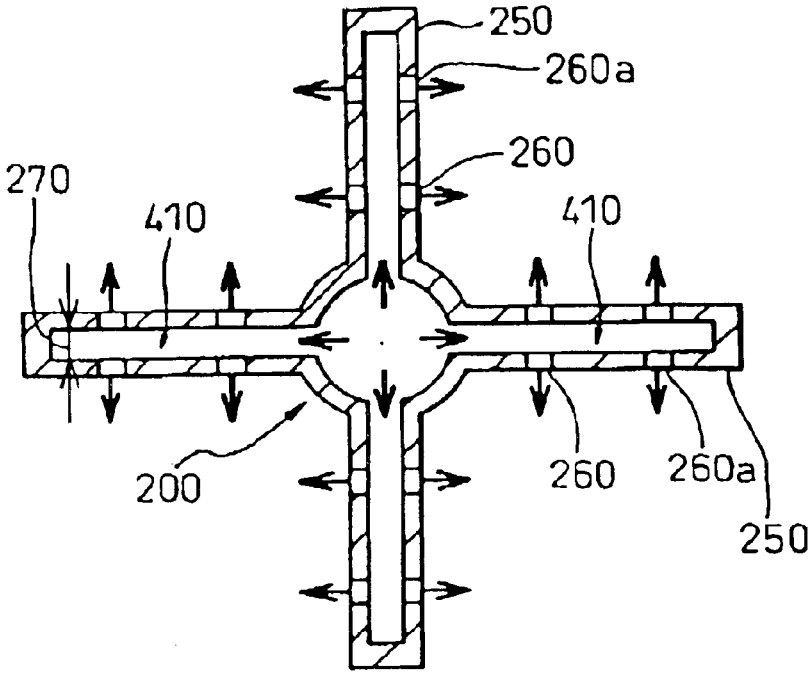
Fig.2a PRIOR ART
FIG. 2*a* is a sectional view taken along the line A—A in FIG. 1.
Figure 2B:
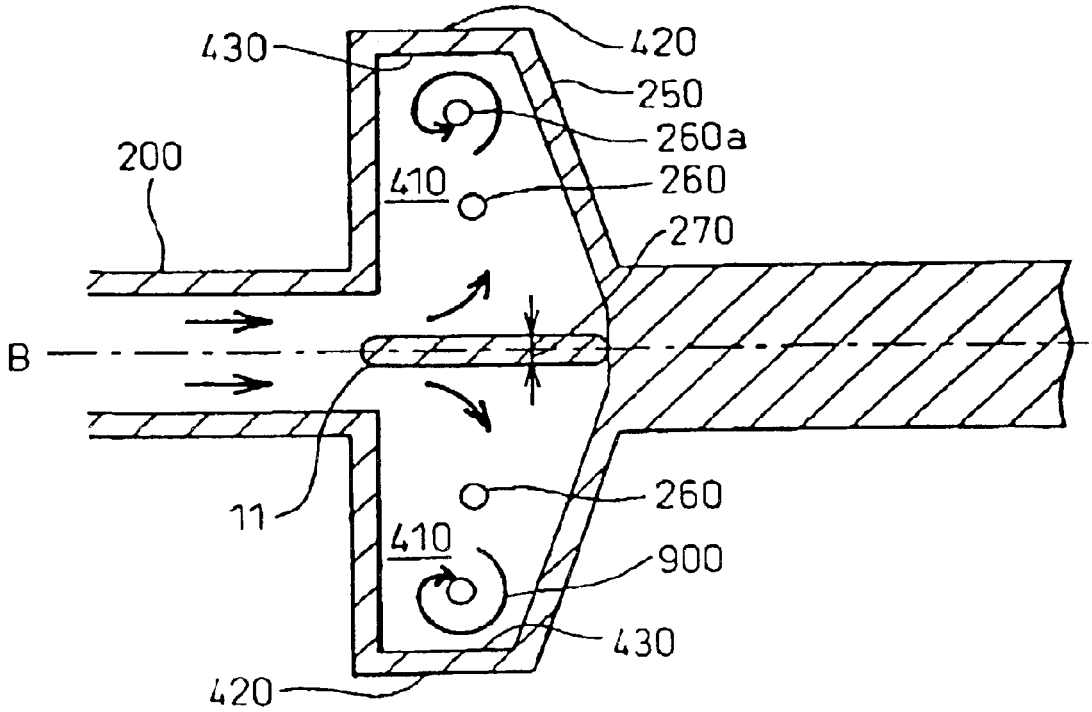
Fig.2b PRIOR ART
FIG. 2*b* is a partially enlarged view in which a fuel nozzle contained in a gas turbine combustor is enlarged.

Embodiments of the present invention will be described below with reference to the accompanying drawings. In the following drawings, similar members are designated by the same reference numerals. The scale of these drawings is changed as necessary for easy understanding.

Figure 3:
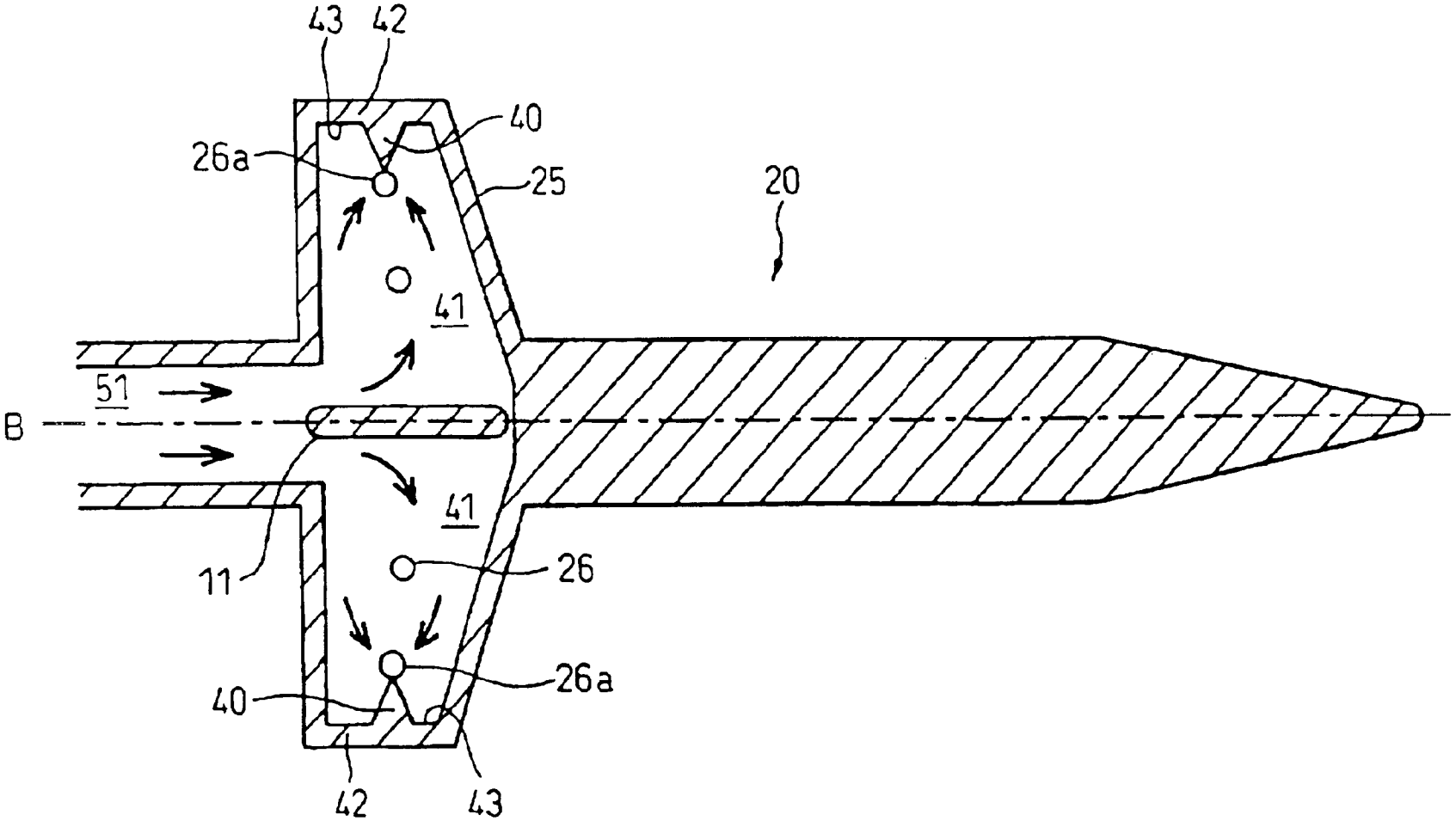
FIG. 3 is an axial direction sectional view of a fuel nozzle contained in a gas turbine combustor according to a first embodiment of the present invention.

FIG. 3 is an axial direction sectional view of a fuel nozzle contained in a gas turbine combustor according to a first embodiment of the present invention. As in a known fuel nozzle 200, the fuel nozzle of the present invention is disposed in the combustor (not shown), and a swirler is provided around the fuel nozzle of the present invention. However, the swirler and the inner tube are omitted for easy understanding. As in the known fuel nozzle 200 described above, the fuel nozzle 200 is disposed, in an air passage to supply air (not shown), substantially parallel with the axis of the air passage. A fuel nozzle 20 has a rodlike body 21 and a plurality of hollow columns 25 extending from the rodlike body 21 in radial directions. At least one injection port, e.g., two injection ports in this embodiment, which can inject fuel in a direction perpendicular to the airflow in the air passage (not shown), are formed in each hollow column 25. As can be seen from FIG. 3, a fuel passage 51 in the rodlike body 21 is connected to fuel passages 41 in the plural hollow columns 25. Therefore, the fuel supplied from a source of fuel (not shown) passes through the fuel passage 51 in the rodlike body 21 and, then, via a flow splitter 11, passes through the fuel passages 41 in the hollow columns 25 in radial directions and, thus, is injected through the injection port 26. As in a known hollow column, the injection port 26 of the present invention is a circle-shaped port having a diameter of 1.8 mm, and the thickness of the passage 41 is 1.5 mm. In the present invention, there is a space between an injection port 26*a* that is most distant from the axis B of the fuel nozzle 20 and an inner wall 43 of the hollow column 25 that is most distant from the axis B. The length of the space is similar to a half of a distance between injection ports that are adjacent to each other.

Figure 4:
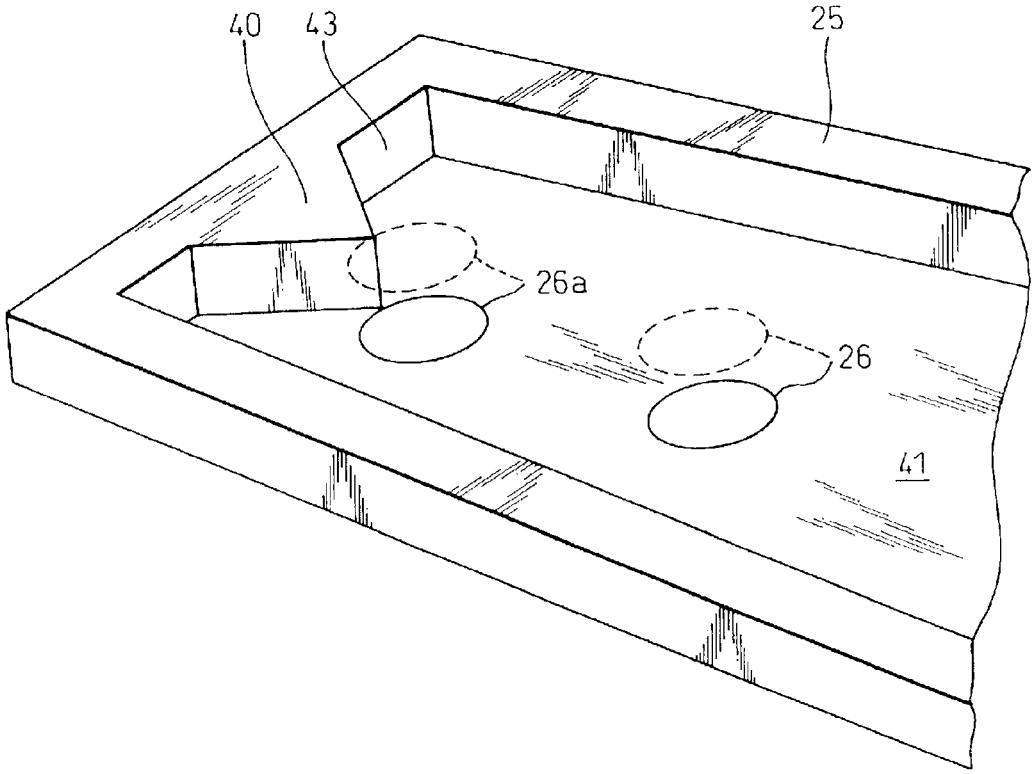
FIG. 4 is an enlarged view in which a surrounding of a projection in a fuel nozzle is enlarged.

As shown in FIG. 3, in the first embodiment of the present invention, a projection 40 is provided in the fuel passage 41 of the hollow column 25. As shown in FIG. 3, the projection 40 inwardly projects from the inner wall 43 of the hollow column 25 that is most distant from the axis B of the rodlike body 21. The projection 40 extends to the injection port 26*a* that is most close to the above-described inner wall 43. FIG. 4 is an enlarged view in which the projection in the fuel nozzle is enlarged. As shown in FIG. 4, the thickness of the projection 40 is substantially equal to the thickness of the fuel passage 41 of the hollow column 25. As illustrated, the projection 40 is disposed so that the tip end of the projection 40 is adjacent to the injection port 26*a* that is most distant from the axis B. In the hollow column 25 containing therein the projection 40, the planar passage 41 is formed by electrical discharge machining or precision casting.

During operation air is supplied into the air passage around the fuel nozzle 20 and, then, it flows in the axial direction of the fuel nozzle 20. Fuel is supplied from a source of fuel (not shown) into the fuel nozzle 20. The fuel flows toward the plural hollow columns 25 through the passage 51 in the rodlike body 21 of the fuel nozzle 20 and, then flows outwardly through the passages 41 of the hollow columns 25 in radial directions. Finally, the fuel is injected into the air passage, in a direction perpendicular to the airflow, through the plural injection ports 26 formed in each hollow column 25. As described above, in this embodiment, the projection 40 is formed in the hollow column 25. The projection 40 shields and prevents the swirl component of the flow of fuel in the vicinity of the tip end 42 of the hollow column 25 and, thus the occurrence of vortex can be prevented.

The amount of flow of fuel injected from each injection port 26 in one hollow column 25 becomes substantially equal by preventing the occurrence of the vortex. Accordingly, pre-mixed air in which air and fuel are uniformly mixed can be produced. Therefore, the amount of $NO_x$, produced when the pre-mixed air is burnt, can be reduced and the flow coefficient can be stabilized and, thus, the combustion vibration can be prevented.

As shown in FIGS. 3 and 4, it is preferable that the space between the tip end of the projection 40 and the farmost injection port 26*a* be minimized or substantially eliminated. Accordingly, the occurrence of the vortex can be substantially eliminated. If the tip end of the projection 40 overlaps the farmost injection port 26*a* and partially covers the injection port 26*a*, the flow coefficient of the injection port 26*a* is lower than that of other injection ports. Accordingly, it is difficult to produce uniform pre-mixed air. The projection 40 of this embodiment is substantially shaped like a triangle. However, any other shape that can prevent the occurrence of swirl flow may be applied.

Figure 5:
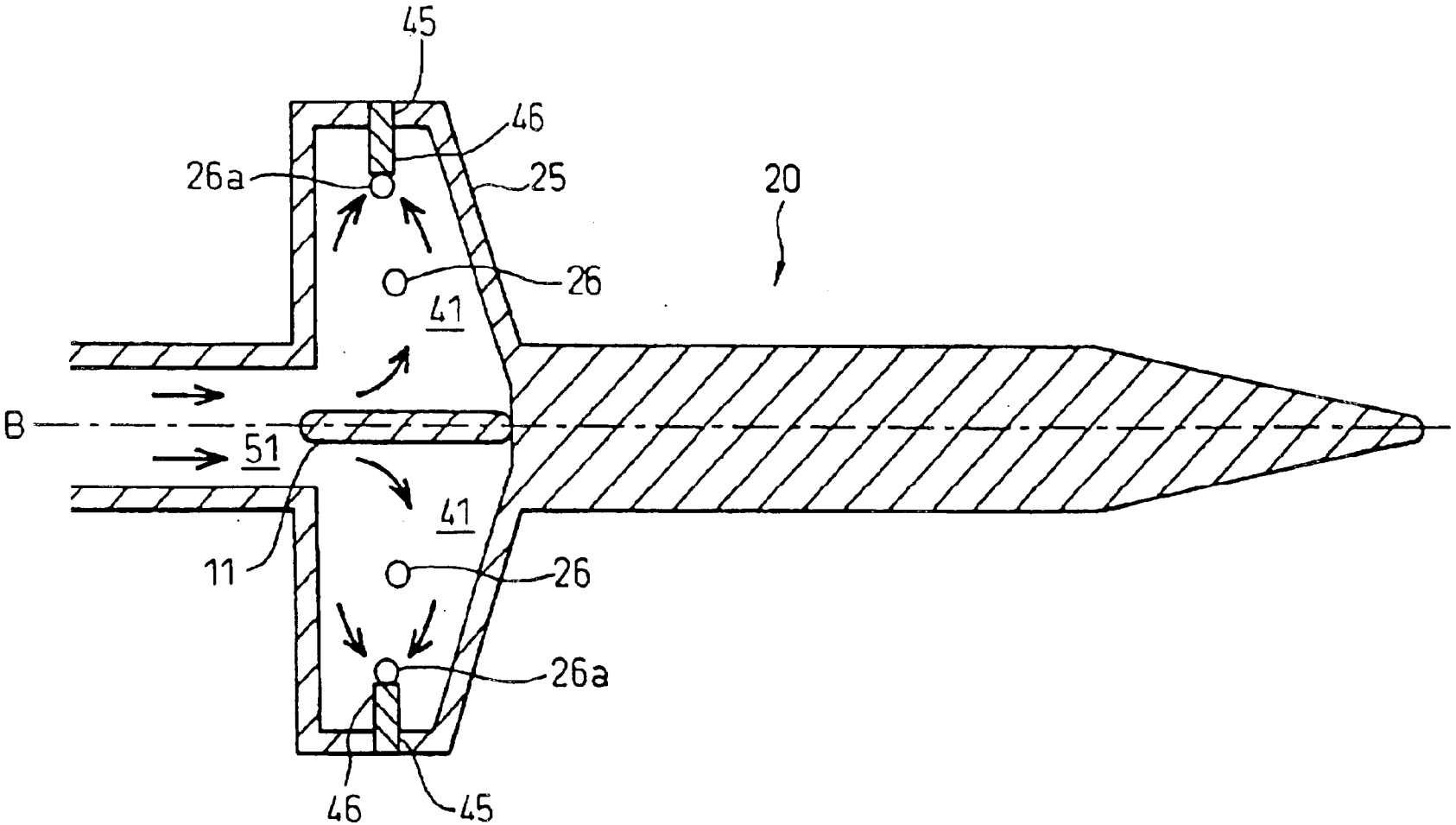
FIG. 5 is an axial direction sectional view of a fuel nozzle contained in a gas turbine according to a second embodiment of the present invention.
Figure 6:
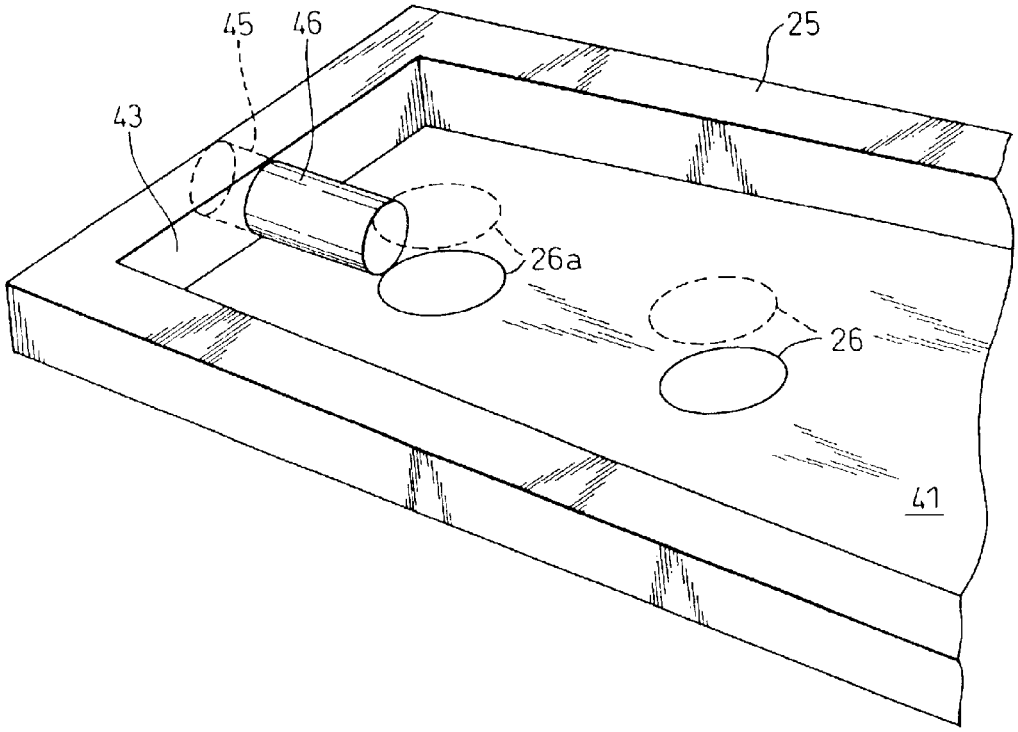
FIG. 6 is an enlarged view in which a surrounding of a columnar member of a fuel nozzle is enlarged.

FIG. 5 is an axial direction sectional view of a fuel nozzle contained in a gas turbine combustor according to a second embodiment of the present invention. FIG. 6 is an enlarged view of a columnar member in a fuel nozzle. In this embodiment, an opening 45 is formed in the inner wall 43 of the hollow column 25 that is most distant from the axis B, and a columnar member 46 is inserted into the opening 45. Similar to the projection 40 in the first embodiment, the inward end portion of the columnar member 46 is disposed such that it is adjacent to the injection port 26*a* that is most distant from the axis B. Namely, a space between the inward end portion of the columnar member 46 and the injection port 26*a* is minimized or substantially eliminated. As can be seen from FIG. 6, the thickness of the columnar member 46 is substantially equal to that of the passage 41 in the hollow column 25. For example, the columnar member 46 is welded into the opening 45 to seal the same. Accordingly, fuel that passes through the passage 41 of the hollow column 25 is prevented from leaking through a space between the opening 45 and the columnar member 46. The hollow column 25 shown in this embodiment is formed by casting and, particularly, by precision casting. A core is used to form a hollow member containing a hollow portion. The core is removed after casting and, then, the columnar member 46 is inserted into the opening for the core and, thus, the hollow column 25 is formed.

Similar to the above-described embodiment, such columnar member 46 shields the swirl components in the passage 41 of the hollow column 25 so as to prevent the occurrence of a vortex. Therefore, the amount of flow of fuel injected from each injection port 26 in one hollow column 25 becomes substantially equal and the flow coefficient of each injection port 26 becomes substantially equal. Accordingly, pre-mixed air in which air and fuel are uniformly mixed can be produced. Therefore, the occurrence of $NO_x$ can be prevented when the pre-mixed air is burnt, and the flow coefficient can be stabilized and, thus, combustion vibration can be prevented. In this embodiment, the hollow column 25 according to this embodiment can be formed by only inserting the columnar member 46 into the opening for the core. Namely, the hollow column 25 according to this embodiment can be easily formed at a low cost in comparison with the hollow column according to the first embodiment formed by electric discharge machining. Therefore, the combustor comprised of the fuel nozzle containing such hollow column 25 can be easily manufactured at a low cost.

Figure 7:
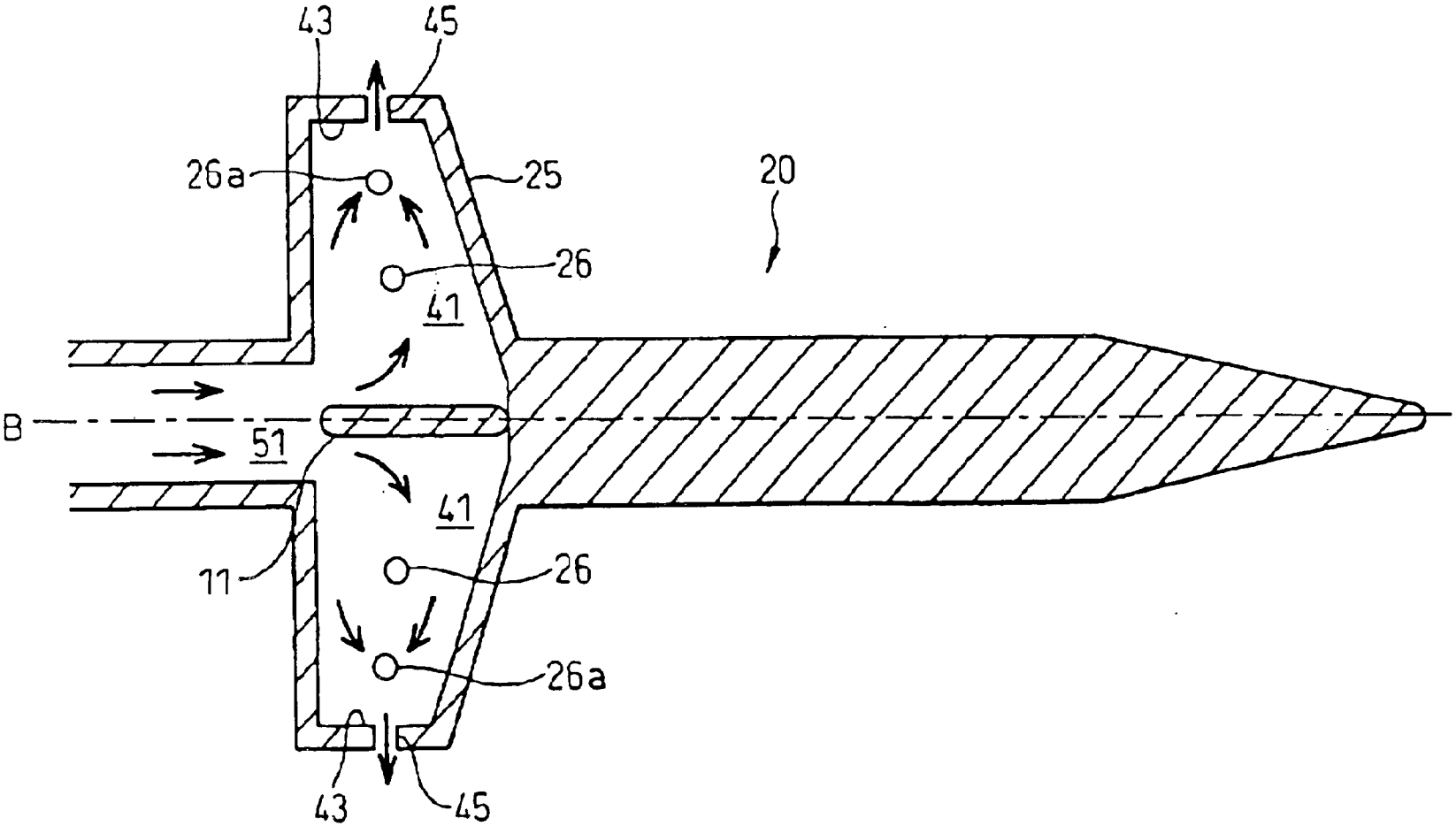
FIG. 7 is an axial direction sectional view of a fuel nozzle contained in a gas turbine combustor according to a third embodiment of the present invention.

FIG. 7 is an axial direction sectional view of a fuel nozzle contained in a gas turbine combustor according to a third embodiment of the present invention. In this embodiment, the columnar member 46 according to the second embodiment is eliminated, and only the opening 45 is formed in the inner wall 43 of the hollow columnar 25 that is most distant from the axis B. Similar to the above described second embodiment, the hollow column 25 according to this embodiment is formed by casting and, particularly, by precision casting.

The opening 45 according to this embodiment makes fuel leak from the hollow column 25 during operation. A part of the fuel leaks through the opening 45, so that a revolving flow is not produced in the vicinity of the tip end of the hollow column 25 and, thus the occurrence of a vortex can be prevented. Therefore, the flow coefficient of the injection port 26*a* that is most distant from the axis B is larger than that of related art, and a difference between the flow coefficient of the injection port 26*a* and that of other injection ports 26 is reduced. Consequently, the occurrence of $NO_x$ can be reduced because uniformly mixed pre-mixed air can be produced, the flow coefficient can be stabilized and, thus, combustion vibration can be prevented. In this embodiment, as the hole for the core to be used in casting operation can be used as the opening for leaking fuel, the hollow column according to this embodiment can be easily formed at a low cost in comparison with the hollow column according to the first embodiment formed by electric discharge machining. Therefore, the combustor comprised of the fuel nozzle containing such hollow column 25 can be easily manufactured at a low cost. The amount of flow of fuel in this embodiment is larger than that in other embodiments because the opening 45 for leaking fuel is provided. Therefore, it is preferable that the size of the injection port 26 in this embodiment is smaller than that in the above described other embodiments.

Figure 8A:
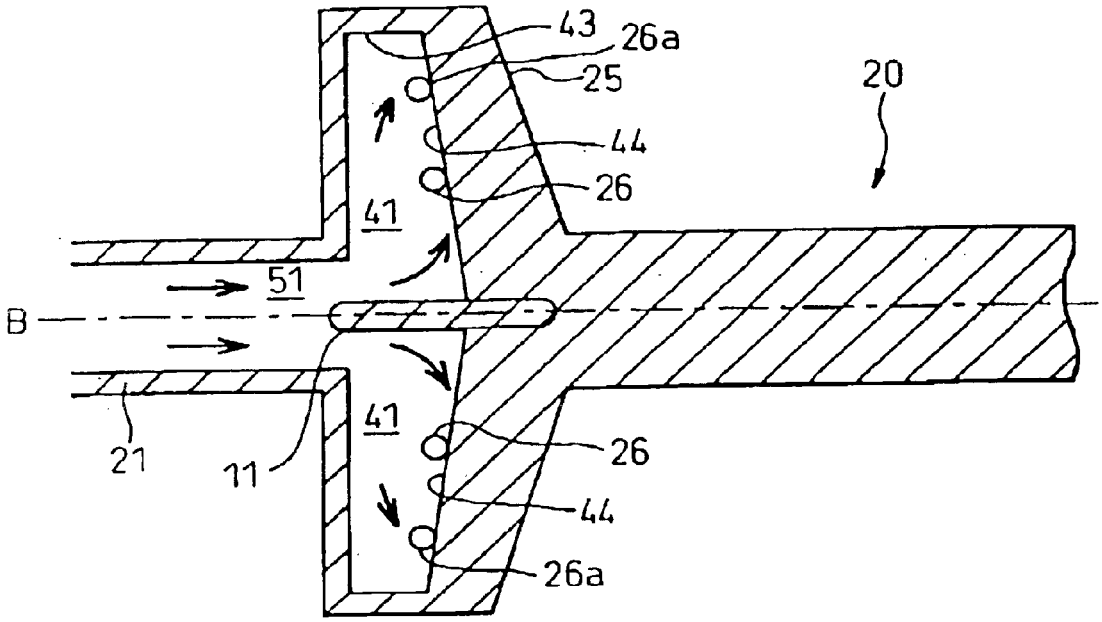
FIG. 8*a* is an axial direction sectional view of a fuel nozzle contained in a gas turbine combustor according to a fourth embodiment of the present invention.
Figure 8B:
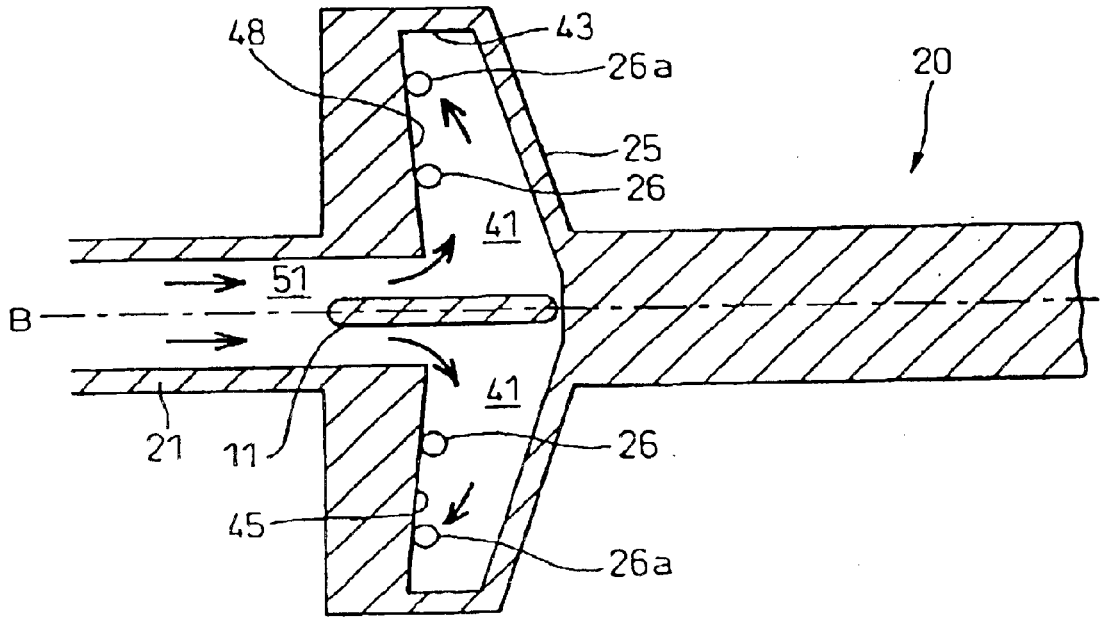
FIG. 8*b* is an axial direction sectional view of a fuel nozzle contained in a gas turbine combustor according to a fifth embodiment of the present invention.

FIGS. 8*a* and 8*b* are axial direction sectional views of fuel nozzles contained in gas turbine combustors according to fourth and fifth embodiments of the present invention, respectively. In these embodiments, the above described projection, opening and columnar member are not provided, and inner walls 48, 44 of the hollow column 25 that are positioned on an upstream or downstream side in the direction of the airflow are disposed to be adjacent to the injection port 26. In FIG. 8*a*, the inner wall 44 of the hollow column 25 that is positioned on a downstream side in the direction of the airflow is disposed to be adjacent to a downstream side of the plural injection ports 26. Likewise, in FIG. 8*b*, the inner wall 48 of the hollow column 25 that is positioned on an upstream side in the direction of the airflow is disposed to be adjacent to an upstream side of the injection port 26.

Namely, in a plurality of injection ports in these embodiments, there is a space between the injection port 26*a* that is most distant from the axis B and the inner wall 43 that is most distant from the axis B, and the inner walls 48, 44 that are positioned on an upstream or downstream side in the direction of the air flow are disposed to be adjacent to an upstream or downstream side of the plural injection ports.

The amount of the flow of fuel passing through each injection port 26 is reduced by positioning the inner wall of the hollow column 25 as shown in FIG. 8*a* or 8*b*. However, a difference between the flow coefficient of the injection port 26*a* that is most distant from the axis B and that of the other injection ports 26 is reduced because each injection port 26 is adjacent to the inner wall of the hollow column 25. Therefore, the occurrence of $NO_x$ can be reduced because the uniformly mixed pre-mixed air can be produced, and the flow coefficient can be stabilized and, thus, the combustion vibration can be prevented. In this embodiment, it is preferable that the size of each injection port is larger than that of the injection port according to the first embodiment. Thus, the reduction of the flow coefficient of each injection port can be prevented. In this embodiment, it is not necessary to form the projection and, thus, the combustor comprised of the fuel nozzle containing such hollow column 25 can be easily manufactured at a low cost.

In the above-described embodiment, the injection port is formed so that fuel is injected in a direction perpendicular to the airflow. However, an injection port formed so that fuel is injected in a direction parallel with the airflow is within the scope of the present invention.

According to the present invention, fuel can be uniformly injected through the injection port because the occurrence of the vortex in the hollow column can be prevented. Thus, there can be obtained a common effect in which the occurrence of $NO_x$ can be reduced because the uniformly mixed pre-mixed air can be produced, and the combustion vibration can be prevented because the flow coefficient can be stabilized.

Although the invention has been shown and described with exemplary embodiments thereof, it should be understood by those skilled in the art that the foregoing and various other changes, omissions and additions may be made therein and thereto without departing from the spirit and the scope of the invention.

What is claimed is:

1. A combustor comprising a fuel nozzle which is comprised of a rodlike body which has a fuel passage and which is located in an air passage;

a plurality of hollow members which are connected to the fuel passage and which extend in radial directions from the rodlike body into the air passage;

at least one injection port formed in each hollow member to inject a fuel from the fuel passage into the air passage; and a projection which extends from a farmost inner wall of each hollow member that is most distant from an axis of the rodlike body to the injection port that is most distant from the axis.

2. A combustor according to claim 1, wherein the projection is a columnar member that is inserted in an opening formed in the farmost inner wall of the hollow member so as to seal the opening.

3. A combustor comprising a fuel nozzle, said fuel nozzle, comprising:

a rodlike body which has a fuel passage and which is located in an air passage;

a plurality of hollow members which are connected to the fuel passage and which extend in radial directions from the rodlike body into the air passage; and at least one injection port formed in each hollow member to inject a fuel from the fuel passage into the air passage, wherein a hole connected to the air passage and through which the fuel leaks is formed in a farmost inner wall of each hollow member that is most distant from an axis of the rodlike body, and an axial axis of said hole is substantially parallel to an axial axis of said hollow member and substantially perpendicular to an axial axis of the rodlike body.

4. A combustor comprising a fuel nozzle, said fuel nozzle, comprising:

a rodlike body which has a fuel passage and which is located in an air passage;

a flow splitter placed inside said fuel passage and oriented along an axial axis of said rodlike body;

a plurality of hollow members which are connected to the fuel passage and which extend in radial directions from the rodlike body into the air passage; and at least one injection port formed in each hollow member to inject a fuel from the fuel passage into the air passage, wherein an inner wall of each hollow member is formed to be directly adjacent to the at least one injection port on an upstream or downstream side in the direction of the airflow.

* * * * *